US011118589B2

(12) United States Patent
Agrawal

(10) Patent No.: US 11,118,589 B2
(45) Date of Patent: Sep. 14, 2021

(54) WATER PUMP

(71) Applicant: EINHELL GERMANY AG, Landau/Isar (DE)

(72) Inventor: Franziska Agrawal, Neu-Ulm (DE)

(73) Assignee: EINHELL GERMANY AG, Landau/Isar (DE)

( * ) Notice: Subject to any disclaimer, the term of this patent is extended or adjusted under 35 U.S.C. 154(b) by 118 days.

(21) Appl. No.: 16/346,265

(22) PCT Filed: Dec. 15, 2017

(86) PCT No.: PCT/EP2017/082980
§ 371 (c)(1),
(2) Date: Apr. 30, 2019

(87) PCT Pub. No.: WO2018/114646
PCT Pub. Date: Jun. 28, 2018

(65) Prior Publication Data

US 2019/0257313 A1 Aug. 22, 2019

(30) Foreign Application Priority Data

Dec. 20, 2016 (EP) ..... 16205526

(51) Int. Cl.
*F04D 15/02* (2006.01)
*F04D 13/06* (2006.01)
(Continued)

(52) U.S. Cl.
CPC ..... *F04D 15/0218* (2013.01); *F04D 13/06* (2013.01); *F04D 15/0005* (2013.01);
(Continued)

(58) Field of Classification Search
CPC ..... F04D 15/0218; F04D 15/005; F04D 15/0077; F04D 15/0209; F04D 15/0227; F04D 13/06; F04D 29/426; F04D 29/708
See application file for complete search history.

(56) References Cited

U.S. PATENT DOCUMENTS

2005/0061813 A1* 3/2005 Vilalta ..... B65D 51/1683 220/212
2006/0083630 A1 4/2006 Chen
(Continued)

FOREIGN PATENT DOCUMENTS

DE 102006023379 A1 * 11/2007 ..... F04D 29/708
DE 102006023379 A1 11/2007
(Continued)

OTHER PUBLICATIONS

English Translation of DE-102006023379-A1 (Volk) obtained Oct. 19, 2020 (Year: 2020).*
(Continued)

*Primary Examiner* — Connor J Tremarche
(74) *Attorney, Agent, or Firm* — Leason Ellis LLP

(57) ABSTRACT

The invention relates to water pump, in particular a garden pump or a pump of a home water machine, which has a pump unit in a housing (GE), which pump unit can be driven by means of an electric motor and can pump water form a suction line (SL) to a pressure line (DL) as a conveyed liquid, wherein the housing comprises a pump housing (PG) connected to the suction line and a housing extension (GF) having the pressure line, which housing extension adjoins the pump housing, wherein the housing extension has a filter unit (FT) as a termination and an at least partially transparent window (FE) is arranged between the suction line and the pressure line such that a liquid level (FL) within the housing can be read on the pump housing from the outside before operation of the pump, and wherein the filter unit has a
(Continued)

Figure 1:
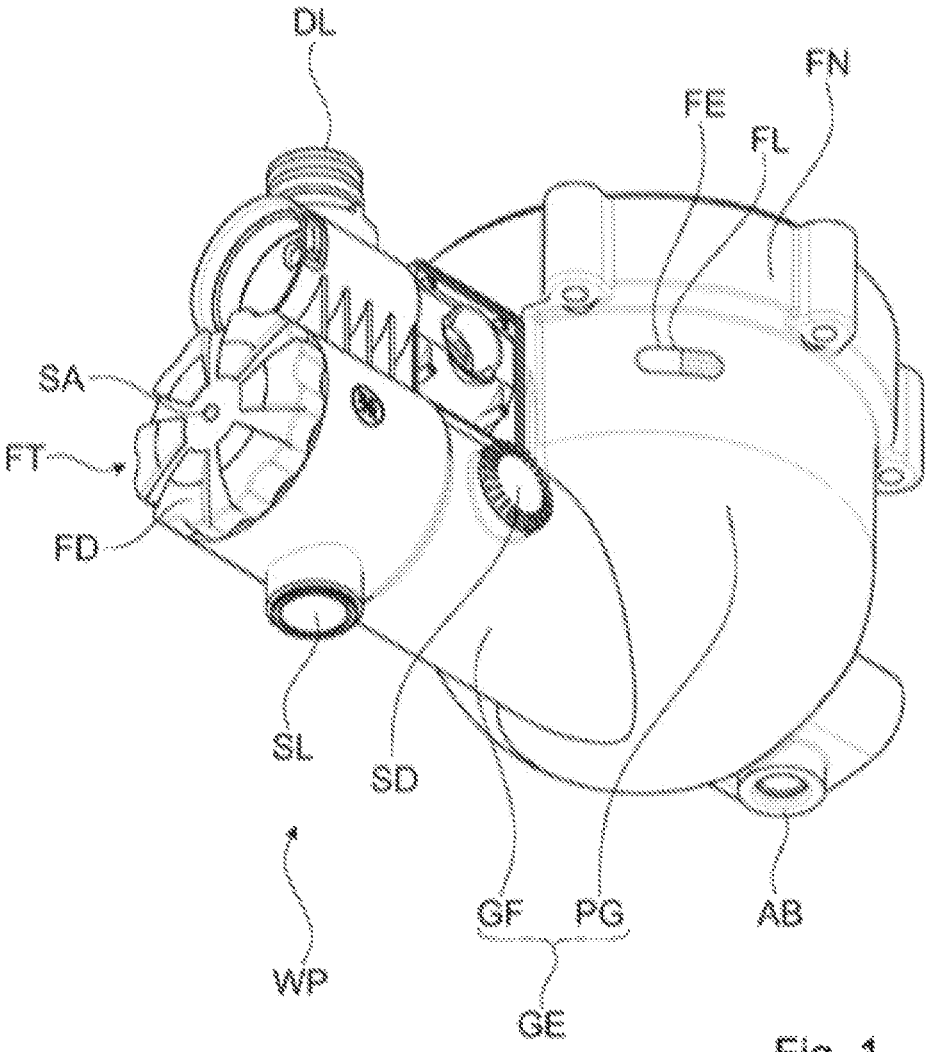

suction indicator (SA) such that the presence of suction pressure in the pump housing can be detected via the suction indicator or a leak at the suction line can be detected.

15 Claims, 6 Drawing Sheets

(51) Int. Cl.
*F04D 29/42* (2006.01)
*F04D 29/70* (2006.01)
*F04D 15/00* (2006.01)

(52) U.S. Cl.
CPC ..... *F04D 15/0077* (2013.01); *F04D 15/0209* (2013.01); *F04D 15/0227* (2013.01); *F04D 29/426* (2013.01); *F04D 29/708* (2013.01)

(56) References Cited

U.S. PATENT DOCUMENTS

| | | | | |
|---|---|---|---|---|
| 2007/0163929 | A1* | 7/2007 | Stiles, Jr. ..... | F04B 49/20 210/97 |
| 2007/0200558 | A1* | 8/2007 | Sellen ..... | G01D 5/202 324/176 |
| 2010/0126604 | A1* | 5/2010 | Lund ..... | F24D 17/0078 137/565.01 |

FOREIGN PATENT DOCUMENTS

| | | | |
|---|---|---|---|
| DE | 202015003085 | U1 | 8/2016 |
| EP | 0544610 | A1 | 6/1993 |

OTHER PUBLICATIONS

International Search Report and Written Opinion in corresponding International Patent Application No. PCT/EP2017/082980 dated Apr. 5, 2018. 12 pages.

* cited by examiner

WATER PUMP

CROSS-REFERENCE TO RELATED PATENT APPLICATIONS

This application is a U.S. National Stage Application under 35 U.S.C. § 371 of International Patent Application No. PCT/EP2017/082980, filed Dec. 15, 2017, which claims the benefit of priority under 35 U.S.C. Section 119(e) of European Patent Application number 16205526.3 filed Dec. 20, 2016, both of which are incorporated by reference in their entireties. The International Application was published on Jun. 28, 2018, as International Publication No. WO 2018/114646 A1.

The invention relates to a water pump, in particular a garden pump or a pump of a home water machine.

In the general state of the art, water pumps are known, which are designed as centrifugal pumps or jet pumps to convey a liquid. These are often provided with a self-priming system, but with larger intake depths a relatively long intake time is required.

Such water pumps are provided as portable or stationary pumps with an electronic control unit and are typically used as garden pumps or as part of a home water machine in home water systems.

Pumps are often provided with an electronic control system, by means of which various additional functions or safety functions can be realized.

DE 10 2013 106 970 A1, for example, discloses a garden pump, which is provided with a controller, so that when starting the pump in the priming phase after a period of 60 seconds, a short break of 4 seconds is programmed. This cycle can be repeated several times until the pump conveys the water.

DE 10 2010 026 474 A1 discloses a garden pump arrangement having a pump driven by an electric drive motor and a control device, which contains a flow rate sensor and switches off the drive motor when a minimum flow rate through the pump output is exceeded, wherein a delay time is set between the time, when the flow rate falls below the minimum flow rate and the engine switch-off. Since the delay time is at least 1.5 minutes and a user-operable control element is provided to switch on the drive motor after a previous switch-off regardless of the output pressure of the pump, no pressure sensor with a switch-on threshold is provided.

The garden pumps known from the prior art therefore provide corresponding solutions for preventing operations, such as dry running or scalding hazards, which may be detrimental to the user, by means of electronic control devices. However, also in the case of self-priming pumps, further steps must be taken by a user to ensure proper start-up, but these steps can usually be performed only after thorough examination of the operating instructions. However, since it can be observed that even with complex technical devices, the operating instructions are often read only when errors occur, but not already during commissioning, installation steps which have to be performed in particular in the case of new users, are not performed or are not carried out correctly.

It is therefore an object of the invention to provide a water pump, which has an increased ease of use with respect to the initial installation and all other initial start-ups.

This object is achieved by the independent claim 1. Further advantageous embodiments of the invention are the subject of the dependent claims. These can be combined in technologically meaningful ways with each other.

The description, in particular in conjunction with the drawings, additionally characterizes and specifies the invention.

According to the invention, a water pump is provided, in particular a garden pump or a pump of a home water machine, which has a pump unit in a housing, which pump unit can be driven by means of an electric motor and can pump water from a suction line to a pressure line as a conveyed liquid, wherein the housing comprises a pump housing connected to the suction line and a housing extension having the pressure line, which housing extension adjoins the pump housing, wherein the housing extension has a filter unit as a termination and an at least partially transparent window is arranged between the suction line and the pressure line such that a liquid level within the housing can be read on the pump housing from the outside before operation of the pump, and wherein the filter unit has a suction indicator such that the presence of suction pressure in the pump housing or a leak at the suction line can be detected via the suction indicator.

Accordingly, a water pump is indicated, in which the filling of the suction line is displayed before starting by an at least partially transparent window being arranged on the housing. A user therefore can see that the suction line was filled to the prescribed liquid level with the pumped liquid. Since the pump housings are typically made of opaque materials in prior art pumps, the user does not receive any information as to whether water is in the pump or not. Since in some applications the pumps can be provided without a return valve and in a first installation they are typically provided with a completely empty suction line, it is therefore required, for a safe operation of the water pump, that the installation steps are carried out in accordance with the instructions in the operating manual. If this does not happen, there is a risk that, for example, a seal of the pump could be damaged if the pump runs dry for a long time. The invention now provides a solution thereto in that the liquid level within the housing may be read from the outside through the partially transparent window, so that the user is informed on whether there may still be installation measures to be taken. This procedure considerably reduces the risk of the pump operating contrary to the instructions in the operating manual. This is particularly important when the water pump has to draw water from a lower level, typically two meters or more, since in this case the suction pressure generated by the water pump is insufficient to fill the suction line. In addition to the filling of the suction line, however, the presence of suction pressure is also important for a correct operation. For this purpose, the invention provides a suction indicator in the area of the filter unit. In particular, when drawing in water from a low level, for example of up to 8 m, it may be necessary for the pump to run dry for an extended period of time in order to draw in water from this region. During this time, however, a user of prior art pumps does not receive any information as to whether the suction process is proceeding correctly. For example, should there be a leak on the suction side, the pump would run dry for a long time without drawing water, so that a switch-off can only be performed over a time window. However, since also during the time window, there is a corresponding suction pressure by the pump upon successful priming during the time window, therefore, there is a reliable signal from the outside by means of the suction indicator, that the suction process will be completed successfully, without having to just wait for the priming to occur. In this case a correct installation would be provided on the side of the water reservoir, since otherwise no suction pressure could be displayed. If, however, the priming behaviour is correctly displayed by the suction indicator, but no liquid is drawn, then at most an incomplete sealing at the connection to the suction line would be considered as a possible source of error. By displaying the suction pressure on the filter lid via the suction indicator, therefore, the reliability of the water pump is significantly improved.

According to a further embodiment of the invention, the suction indicator exerts, during the suction of liquid, a pressure on a display element, so that suction pressure may be recognized on a filter lid.

In this case, the pressure can be exerted on the suction indicator via a membrane, which is held by a receptacle arranged on the side facing away from the filter lid. The membrane can be subject to a force with respect to the receptacle by means of an elastic spring element, in particular a spiral spring or an adjustable spiral spring having an adjustable bias. It is also possible to provide an additional suction indicator, which is preferably coaxially arranged with respect to the suction indicator.

Accordingly, both fixed and variable ranges or even multiple ranges of suction pressure can be displayed. Depending on the application and the associated installation height of the water pump, therefore, a corresponding default setting can be factory-set by selecting the appropriate suction indicator.

In order to be able to read the liquid level in the interior of the water pump, according to an advantageous embodiment of the invention, the window is directly arranged on the pump housing, in which case, for example, a configuration in the form of a porthole or a small slot-like window opening would be possible. However in other embodiments it is also provided to arrange the at least partially transparent window on the preferably cylindrical housing extension, wherein this can be done both by the fact that the housing extension is provided with a slot-like configuration of the transparent window, so that the water level between the suction line and the pressure line can be read from the outside. In yet another embodiment, it is provided that the at least partially transparent window is part of the filter unit preferably acting as a filling opening. Since the filter unit can typically also be used as a filling opening and thus forms the termination of the housing extension, at this point, due to the transparent design of the housing, both the correct filling of the suction line and any additional accumulation of material in the filter can be read from the outside. For this purpose, the filter unit has side walls which can be produced at least portion-wise, preferably entirely, of an optically at least partially transparent material.

The above-mentioned measures, individually and in combination, allow a high level of user comfort, in particular during maintenance or commissioning of the water pump. In addition, it is also possible, both as an alternative and in addition to the reading through the transparent window by the user, to provide a liquid sensor which detects the liquid level in the region of the pump housing and signals the same at the transparent window. Accordingly, the correct filling of the suction line is displayed automatically, wherein in this case the transparent window would be the cover of a light emitting diode, for example. A coupling of the liquid sensor to a control unit, for example, which may prevent a commissioning in case of no filling, is also provided in the context of the invention.

According to a further embodiment of the invention, a pressure sensor is arranged on the pressure line, which pressure sensor is connected to a control unit.

The combination of pressure sensor and control unit allows, in particular, the detection of a loss of pressure on the load side, so that in combination with a pressure reservoir, such as a water tank or the like, a home water machine may be provided, which reacts with a delay to a loss of pressure also on the load side. Furthermore, the pressure sensor can activate status indicators via the control unit, which can indicate operating states of the water pump in the form of LEDs, for example.

According to a further embodiment of the invention, a return valve is provided, which is part of the filter unit serving as a filling opening.

In order to be able to fill the suction line at the start of commissioning, the pumped liquid is introduced via the filling opening on the side of the water pump. However, the return valve is intended to prevent this, so that it must be deactivated during commissioning, provided that the filling of the pumped liquid is to be made above the return valve. Due to the fact that the return valve is part of the filling opening, the return valve is forcibly deactivated by removing the filling opening.

In another embodiment, a return valve having an automatic vent is provided.

In this case, if the filling of the suction line has to be made during commissioning below the return valve, a venting possibility has still to be provided to be able to discharge the air present in the suction line accordingly. In this case, the invention provides an automatic venting, which, for example, can divert the exiting air without the intervention of a user.

For automatic venting, the return valve may have at least one passage channel which serves as a vent when the suction line is filled with conveyed fluid when the return valve is closed, wherein the at least one passage channel can be closed by a sealing ring when the pump unit is activated. In this case, the passage channel can be arranged on a valve plate of the return valve. The sealing ring is arranged in a slidable manner with an overlying adjusting disk on the side of the pressure line along a valve stem of the return valve under the action of a spring bias.

In this embodiment, the check valve can be integrated into the water pump, wherein the ventilation of the water pump when filling with water on the side of the suction line requires no manual intervention, in that passage channels are provided on the valve plate, which are secured with a sealing disk and a support disk. When filling water into the suction line, the pump is depressurized, so that the sealing ring leaves the passage channel open, so that air can escape through the passage channels. The size of the passage channels is chosen so that the water can flow into the suction line, while the air can escape. During operation of the water pump a pressure is generated in the pressure chamber and the sealing disk closes.

In addition, it is provided that the return valve actuates a switch which emits a signal to a control device in the event of dry running.

Accordingly, the state of dry running is reliably detected, in particular with longer priming times due to water bubbles or increased water temperature, so that the control device can monitor a safe pumping operation with a corresponding time specification for the maximum dry running time. The switch is preferably magnetically activated so that, for example, a REED switch or a Hall sensor is used, which is actuated by means of a magnet arranged on the return valve. Alternatively, or additionally, the switch can also trigger a scalding protection, which is activated, for example, if the water pump is operated against a closed pressure line, in which case the water within the water pump is heated by the pump unit.

Some embodiments will be explained in more detail in the following with reference to the drawings.

Figure 2:
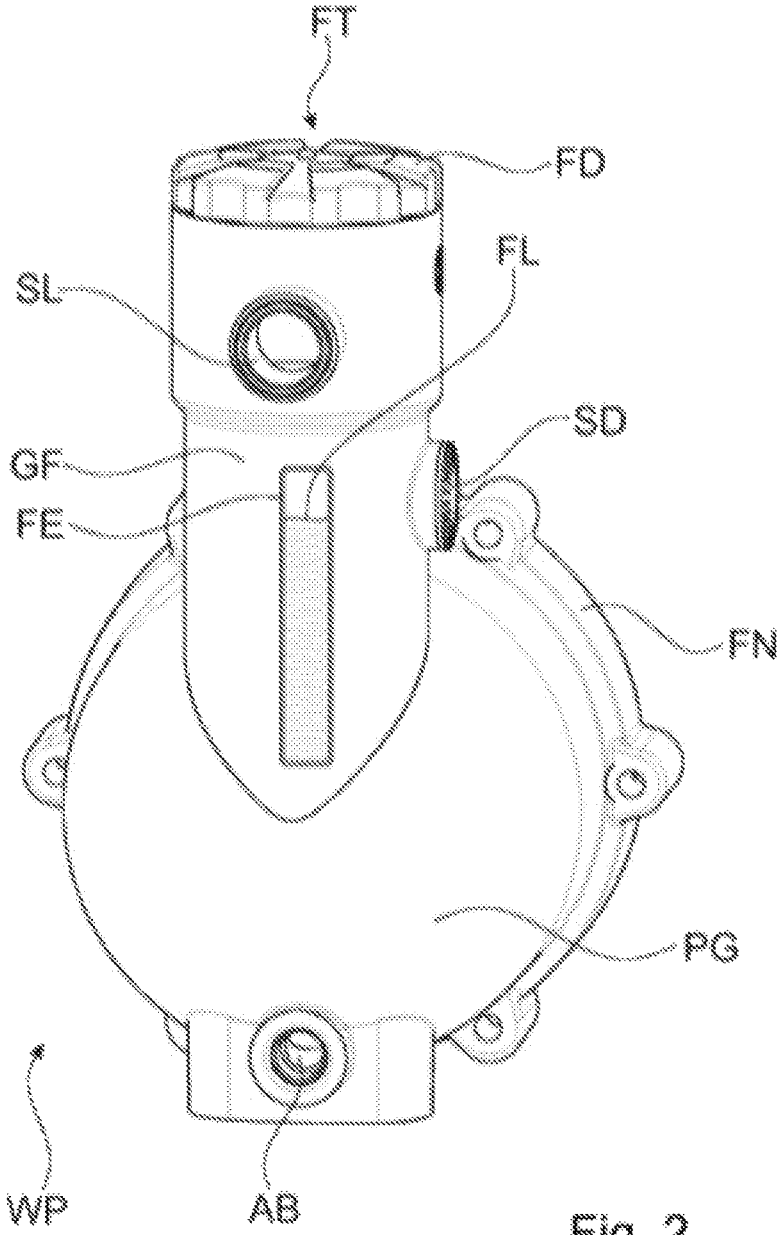
Figure 3:
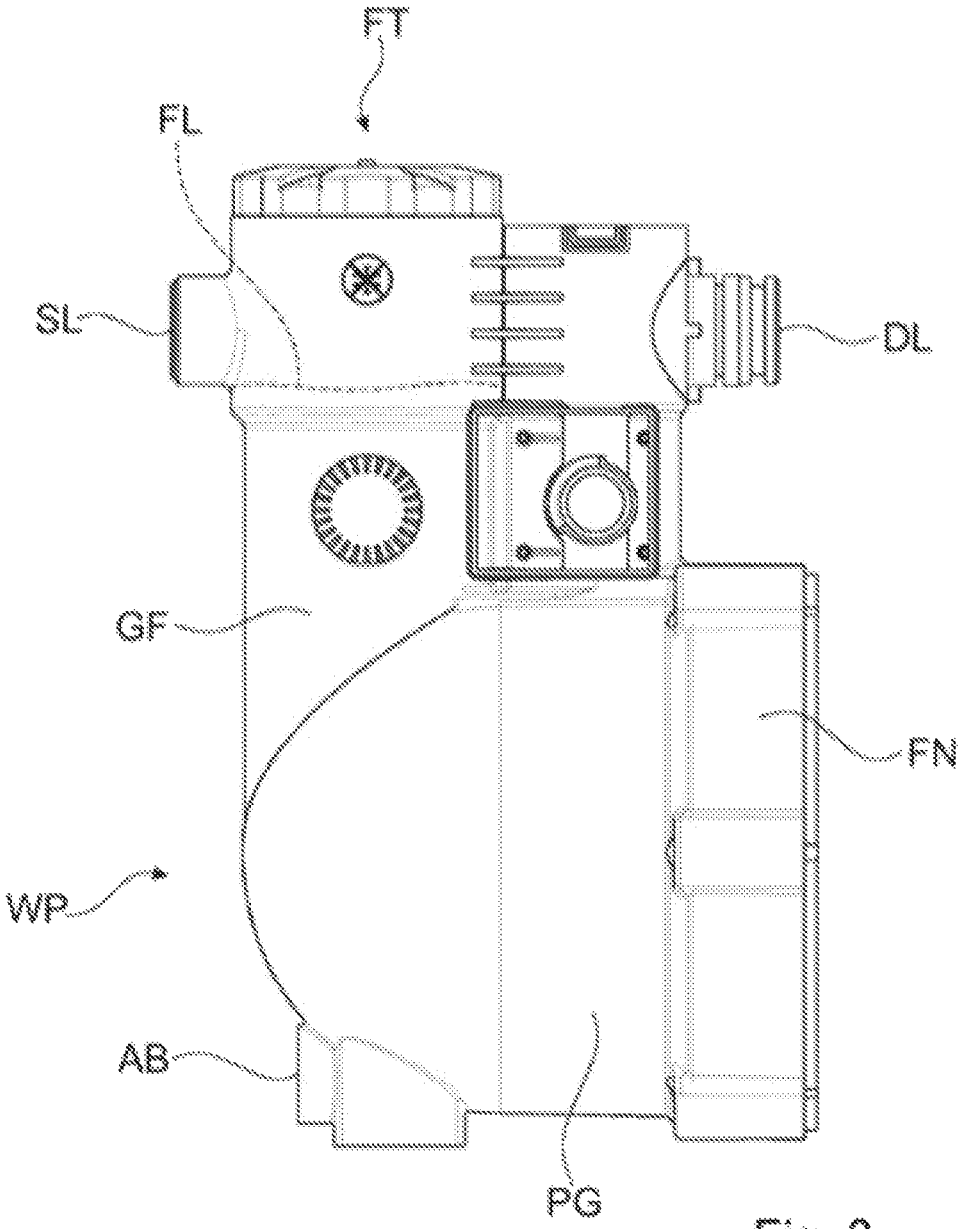
Figure 4:
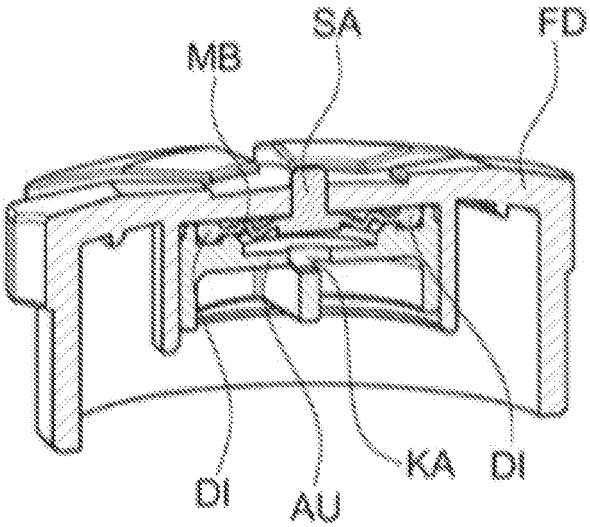
Figure 5:
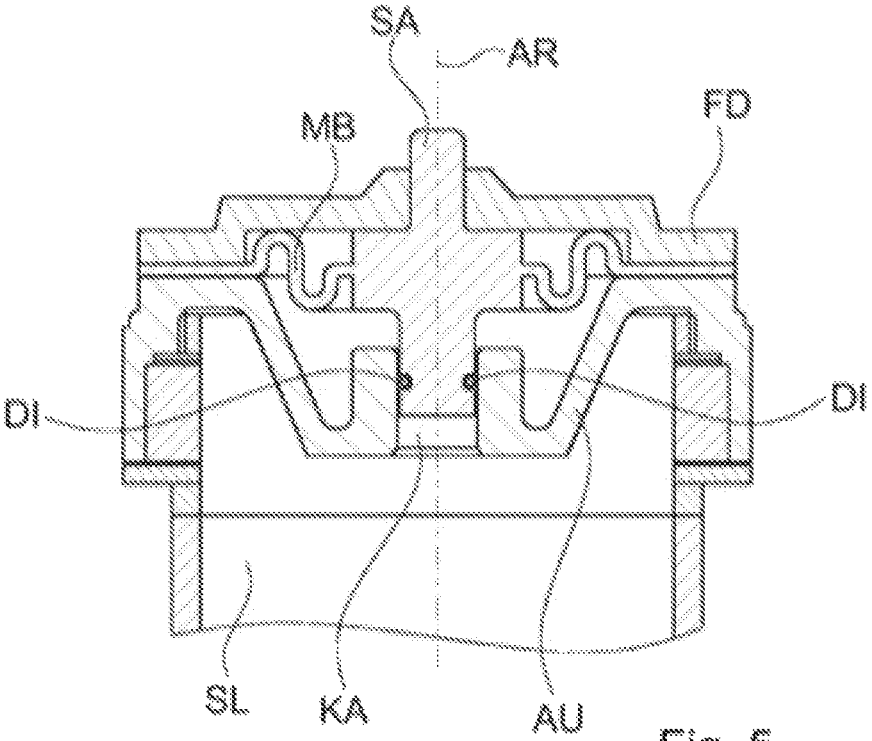
Figure 6:
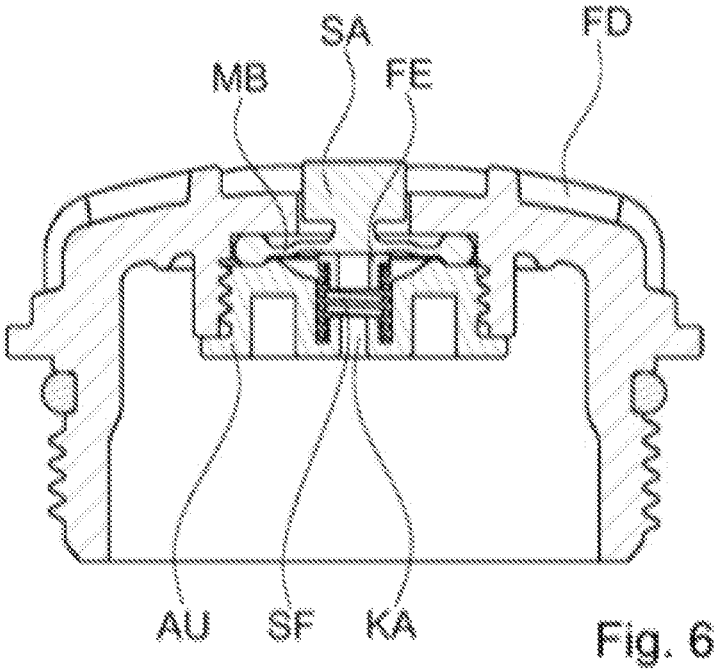
Figure 7:
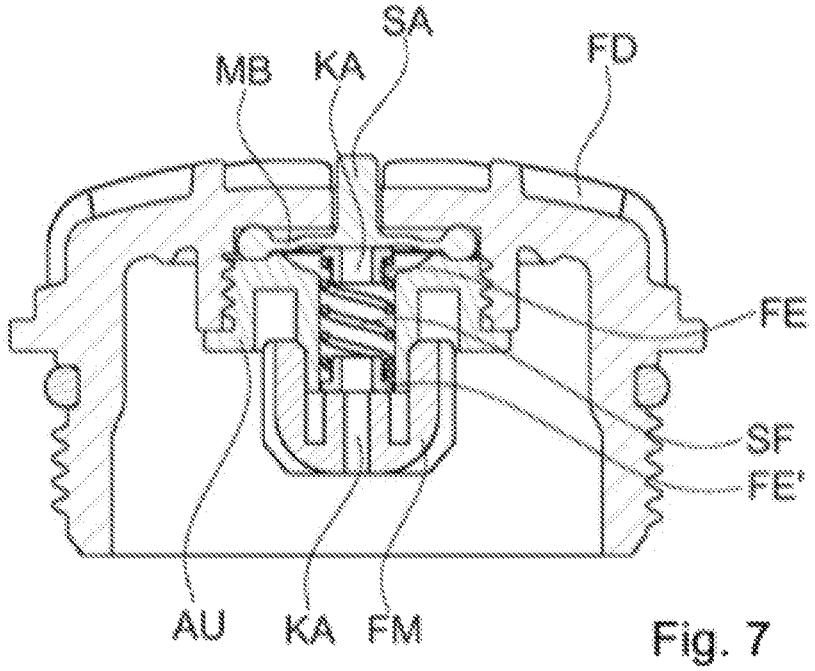
Figure 8:
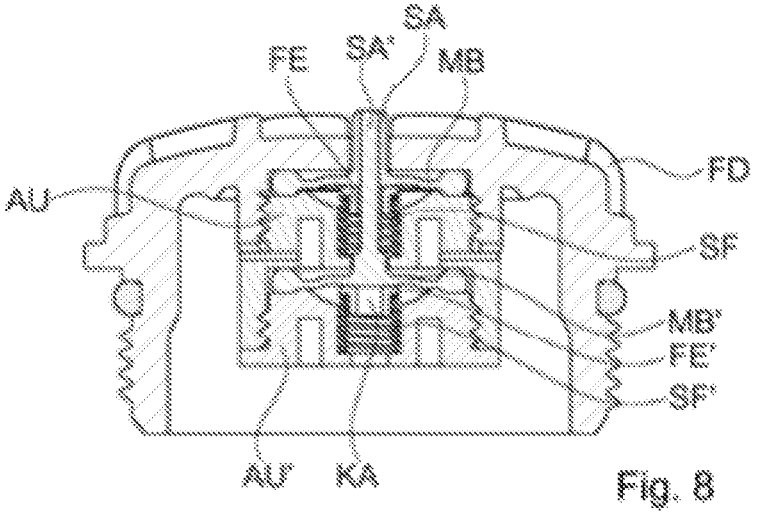
Figure 9:
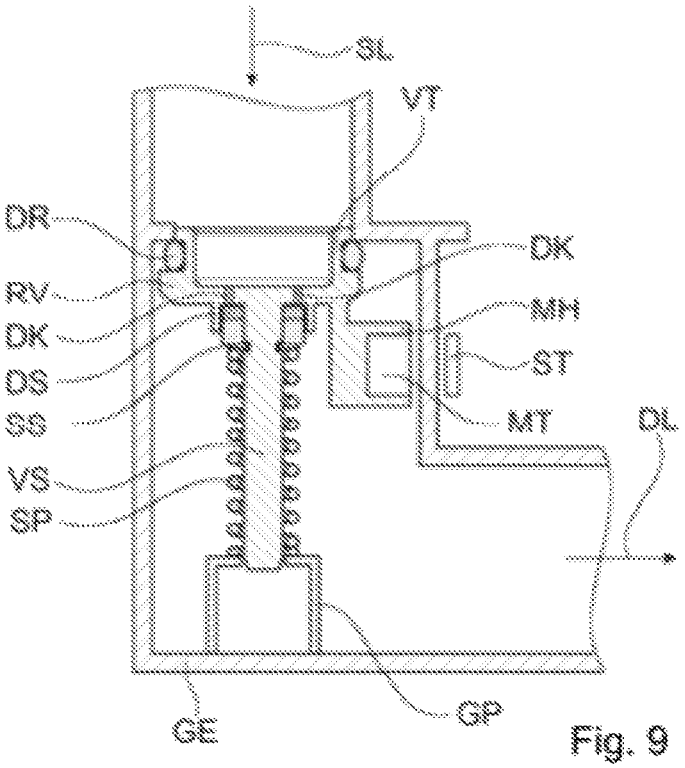

FIG. 1 is a perspective side view of a part of a water pump according to the invention according to a first embodiment of the invention, FIG. 2 is a perspective side view of a part of a water pump according to the invention according to a second embodiment of the invention, FIG. 3 is a perspective side view of a part of a water pump according to the invention according to a third embodiment of the invention, FIG. 4 is a cross section through a filter lid for a water pump according to the invention according to a perspective side view, FIG. 5 is a cross-sectional view through another filter lid for a water pump according to the invention, FIG. 6 is a cross-sectional view through another filter lid for a water pump according to the invention, FIG. 7 is a cross-sectional view through another filter lid for a water pump according to the invention, FIG. 8 is a cross-sectional view through another filter lid for a water pump according to the invention, and FIG. 9 is a return valve with an automatic vent for a water pump according to the invention.

In the figures, identical or functionally identical components are provided with the same reference numerals.

In FIG. 1, a water pump according to the invention is shown in a perspective side view obliquely from above, with those components which are essential for the explanation of the invention. The other components necessary for carrying out the invention are, however, known to a person skilled in the art.

The water pump WP in the illustration according to FIG. 1 comprises a housing GE, which is composed of a pump housing PG and an adjoining cylindrically formed housing extension GF. On the bottom of the pump housing PG there is a drain AB. At the upper end of the cylindrically shaped housing extension GF, a connection for a suction line SL is attached. A flange FN on the pump housing PG typically houses the pump unit driven by an electric motor (not shown in FIG. 1).

The housing extension GF is closed by a filter unit FT, which has a filter lid FD on its upper side. Furthermore, the housing extension GF is connected to a connection for a pressure line DL, which can pass on the water suctioned via the suction line SL depending on the application of the water pump. In order to monitor the possible accumulation of foreign bodies within the filter unit FT, optionally a transparent window (not shown in FIG. 1) may be provided, which is particularly advantageous when the filter housing is made of non-transparent material. The housing extension GF or the pump housing PG are typically also made of opaque plastics material or metallic materials.

During initial commissioning, it is necessary to fill the pump housing PG with water, which is the pumped liquid. In order to be able to recognize during starting up that the pump housing PG has been filled with the fluid to be conveyed, according to the invention a transparent window FE is provided which, when correctly filled, allows a reading of the fluid level FL from the outside. In the example shown in FIG. 1, the liquid level FL is signalled via a transparent window FE attached to the pump housing PG. The correct filling with the conveyed liquid can not only be indicated via a liquid level FL within the transparent window FE but also generally by a complete covering of the transparent window FE with conveyed liquid, so that only the presence but not the exact level of the conveyed liquid is displayed. Both are comprised, according to the invention, by the term "liquid level FL". Alternatively, or additionally, a screw lid SD made of transparent material or having a transparent insert may also be provided.

Further embodiments of the transparent window FE will be described in more detail below with reference to FIGS. 2 and 3.

After the correct filling, the water pump WP draws the conveyed liquid at the suction line SL. This is indicated by a suction indicator SA disposed in the filter lid FD, which is in the form of a pin, wherein the suction indicator SA protrudes from the filter lid FD before operation and is pushed into the filter lid FD during operation of the water pump WP. Detailed embodiments will be described in more detail below with reference to FIGS. 4 to 8.

As will be described below with reference to FIG. 9, a return valve may be mounted between the pressure line DL and the suction line SL. In order to be able to discharge the conveyed liquid located downstream of the return valve in the pressure line DL, for example when the water pump WP is shut down, the drain AB is provided, so that the conveyed liquid located in the pressure line DL can flow out through an opening.

Another embodiment of the water pump WP is shown with reference to FIG. 2. Here, the water pump WP is shown in a perspective side view in the direction of a front side. It can be seen that the housing extension GF is provided with a transparent window FE having an elongated form, via which the correct filling of the suction line SL on the water pump WP can be read on the basis of the liquid level FL.

Another embodiment of the water pump WP is shown in FIG. 3. FIG. 3 shows the pump in a perspective side view, wherein here, in contrast to the previous embodiment, the housing of the filter unit FT consists of a transparent plastics material, so that the liquid level FL can be read within the side walls of the filter unit FT. For this purpose, the filter unit FT has side walls which are at least partially but preferably completely made of an optically transparent material.

As an alternative or in addition to the embodiments according to FIGS. 1 to 3, it would also be possible to attach a liquid sensor, which can electronically provide evidence of the presence of conveyed liquid within the housing GE.

As shown in FIG. 1, the filter unit FT has a filter lid FD, which according to further embodiments of the invention may be provided with a suction indicator SA. The suction indicator SA will be described in more detail below with reference to FIGS. 4 to 8 in several embodiments.

In FIG. 4, the filter lid FD is shown schematically in a perspective cross-sectional view. It can be seen that a membrane MB, which can exert a certain axial spring force, opens outwards into a seal DI, so that a water-tight seal is provided between a receptacle AU and the filter lid FD. In a central part of the membrane MB the suction indicator SA is provided, which may be guided through an opening in the filter lid FD to the outside, wherein in the presence of a pressure inside the filter unit FT the membrane MB correspondingly pulls via a channel KA the suction indicator SA inwards or pushes it out when no pressure is present. As a result, via the suction indicator SA designed as a pin-shaped display element it is possible to detect the presence of a suction pressure in the interior of the water pump and to display it to a user.

Another embodiment is shown in FIG. 5 in a cross-sectional view. Here, the seal DI is located within the channel KA on a cylindrical rod of the suction indicator SA. The membrane MB is arranged together with the suction indicator SA between the receptacle AU and filter lid FD. Again, the membrane MB is provided with a corresponding axial spring force, wherein the presence of suction pressure can also ensure, as described above, an axial displacement of the suction indicator SA through the filter lid FD.

Another embodiment of a suction indicator SA is shown in FIG. 6 in a cross-sectional view. The suction indicator SA is again connected to a membrane MB arranged on a receptacle AU, which membrane is arranged below the filter lid FD, so that the suction indicator SA can penetrate the filter lid FD due to an axial displacement. However, in contrast to the previously described embodiment according to FIG. 5, the suction indicator SA has larger external dimensions transversely to the axial displacement direction, so that the suction indicator SA is present not only in the form of a pin-shaped display element but also in the form of an enlarged contact surface on the filter lid FD. On the opposite side of the membrane MB a spiral spring SF is provided at the receptacle AU, which spring is connected via a spring plate FE to the suction indicator SA and the membrane MB. The spring plate FE prevents the spiral spring SF from contacting the membrane MB, which could possibly lead to damage or at least impede the assembly. Inside the spiral spring SF, the channel KA is again arranged, so that with a corresponding suction pressure, an axial displacement of the suction indicator SA is possible. The membrane MB in the embodiment of FIG. 6 is biased by the spiral spring SF, so that also higher suction pressure values can be displayed. Furthermore, the suction indicator SA can also be used to build a pumping action by rhythmic actuation and thereby manually generate suction pressure. This could be advantageous, for example, when commissioning the water pump WP. The prerequisite for this is to install a check valve at the end of the suction line.

FIG. 7 again shows a variation of the embodiment just described. The spiral spring SF has on the side opposite the membrane MB a locking means FM, so that via a spring plate FE', the bias of the coil spring SF can be adjusted by adjusting the adjustment means FM. In order not to impair the function, the locking means FM must also be in communication in the axial direction with the channel KA. Thus, it is possible to perform an adjustment of the suction indicator SA by adjusting the adjusting means FM at different installation heights of the water pump WP with respect to the water level of the water to be pumped. The spring plate FE and the spring plate FE', as mentioned above, only ensure the mechanical protection of adjacent components, in particular, the membrane MB, wherein in other embodiments, the suction indicator SA could be provided without a spring plate FE.

The adjusting means FM could also have corresponding area markings together with the recording AU or it could be adjustable in discrete steps marked accordingly in the receptacle AU, so that a user can set the functional area of the suction indicator SA in a controlled way corresponding to the appropriate installation height of the water pump WP.

Referring now to FIG. 8, there is shown a third embodiment of a spring-loaded suction indicator SA. In this embodiment, the suction indicator SA described in connection with FIG. 6 is modified so that it is hollow-cylindrical in the axial direction, so that a further suction indicator SA' can be inserted coaxially into the interior of the suction indicator SA. The further suction indicator SA' is in turn connected to a further membrane MB', which comes to rest below the receptacle AU in a further receptacle AU'. The further membrane MB' is also biased by a spiral spring SF', which is connected to the additional membrane MB' via a spring plate FE'. Consequently, a double suction indication SA or SA' is provided, wherein depending on the suction pressure only one or both indicators emerge from the filter lid FD.

Such an embodiment can be used, for example, for displaying two different pressure ranges by means of the suction SA and SA' depending on the desired installation height of the water pump WP. Thus, when installing the water pump WP at a first lower height, only the suction indicator SA would be pulled into the filter lid FD, since at this height the pressure in the suction line would not be high enough to cause a lowering of the suction indicator SA against the spiral spring SF'. At a second larger height of the water pump WP with respect to the water to be pumped, the pressure is then high enough, so that the further suction indicator SA' is also pulled into the filter lid FD. The manufacturer may thus provide a differentiation between different ranges by varying the elastic constants of the spiral springs SF or SF'. A locking medium FM, as shown in FIG. 7, is not required here, but could for example be provided for the further suction indicator SA', as this would be accessible from below by a user. The suction indicator SA and the further suction indicator SA', if present, according to the embodiments of FIGS. 4 to 8 allow the indication of the presence of a suction-side leakage, since in this case the pin-shaped indicators cannot be pulled into the filter lid FD. As already mentioned in the introduction, this is advantageous during commissioning, especially at high installation heights. Typically, the installation height can be up to 8 m, wherein in the case of the two-part suction indicator of FIG. 7, a region up to 4 m for the first suction indicator SA and starting from 4 m for the second suction indicator SA' could be selected.

To prevent a backflow of water into the suction line SL, water pumps are often provided with return valves. However, since at the beginning of the pumping operation when the water pump WP is started up, the suction line SL must be filled with water, such return valves are mechanically blocked, so that they are deactivated. According to the invention, it is provided to install a return valve within the filter unit FT, which simultaneously acts via the filter lid FD as a filling opening for the introduction of conveyed liquid during start. Therefore, the filter unit FT is removed together with the return valve, so that no such mechanical actuation by a user is necessary.

A further embodiment uses for this purpose an automatic venting, wherein essential elements of such a return valve RV are sketched in the cross-sectional view of FIG. 9.

The return valve RV comprises a valve plate VT, which opens via a valve stem VS in a housing plate GP. The housing plate GP is arranged on the housing GE. The valve plate VT and the valve stem VS are arranged on the pressure side on the side of the pressure line DL and can be sealed by a sealing ring DR against the suction side of the suction line SL. The valve stem VS is biased by a corresponding spiral spring SP, which is supported against the housing plate GP. Accordingly, due to the return valve RV no water from the pressure line DL can flow back into the suction line SL.

During filling, however, the pump is depressurized, so that passageways DK in the valve plate VT sealed by a corresponding sealing disk DS, which are additionally held by a locking washer SS, are open, so that both water can be brought through the passageways DK in the suction line SL, as well as air from the suction line SL can escape via the passage channels DK. The sealing disk DS is arranged directly above the passage channels DK on the side of the pressure line DL and is covered by the locking washer SS.

Accordingly, a return valve RV is created, which both prevents a back flow in normal operation and allows automatic venting during starting up. Since the displacement of the valve plate VT is related to the presence of suction pressure, the return valve RV can also be supplemented by a switch ST, which is used to detect dry running or overheating. For this purpose, the valve plate VT is provided with a magnet holder MH which can hold a magnet MT. The switch ST which is outside the area of the lines is a REED switch or a Hall sensor and can detect the displacement of the magnet MT and thus transmits a signal to a control device.

The features indicated above, and in the claims, as well as the features which can be seen in the figures, can be implemented advantageously both individually and in various combinations. The invention is not limited to the exemplary embodiments described, but can be modified in many ways within the knowledge of the skilled in the art.

The invention claimed is:

1. A water pump, in particular a garden pump or a pump of a home water machine, which has a pump unit in a housing (GE), which pump unit can be driven by means of an electric motor and can pump water from a suction line (SL) to a pressure line (DL) as a conveyed liquid, wherein the housing (GE) comprises a pump housing (PG) and a housing extension (GF) having the pressure line (DL) and the suction line (SL), which housing extension adjoins the pump housing (PG), wherein the housing extension has a filter unit (FT) as a termination and an at least partially transparent window (FE) is arranged between the suction line (SL) and the pressure line (DL) such that a liquid level (FL) within the housing (GE) can be read from the outside before operation of the pump (WP), and wherein the filter unit (FT) has a suction indicator (SA) such that the presence of suction pressure in the pump housing (PG) or a leak before the suction line (SL) can be detected via the suction indicator (SA);

wherein a return valve (RV) is provided, which has an automatic venting; and wherein the return valve (RV) has at least one passage channel (DK), which operates as a vent upon filling the suction line (SL) with the conveyed liquid, when the return valve (RV) is closed, wherein the at least one passage channel (DK) may be closed by a sealing ring (DR) upon activation of the pump unit.

2. The water pump according to claim 1, wherein the suction indicator (SA) exerts a pressure on an indicator element arranged on a filter lid (FD) during suction of liquid such that both the liquid level inside the housing and the suction pressure in the pump housing can be viewed.

3. The water pump according to claim 1, in which the pressure is exerted via a membrane (MB) on the suction indicator (SA), which membrane is held by a receptacle (AU) which is arranged on the side facing away from the filter lid (FD).

4. The water pump according to claim 3, in which the membrane (MB) opposite the receptacle (AU) is subject to a force by means of an elastic spring element, in particular a spiral spring (SF) or a spiral spring (SF), the biasing force of which is adjustable by means of a fixing means (FM).

5. The water pump according to claim 1, in which a further suction indicator (SN) is provided, which is arranged coaxially with respect to the suction indicator (SA) and which indicates a higher suction pressure.

6. The water pump according to claim 1, in which the at least partially transparent window (FE) is arranged on the pump housing (PG) or on the housing extension (GF).

7. The water pump according to claim 6, in which the at least partially transparent window (FE) is part of the filter unit (FT) which is used as a filling opening.

8. The water pump according to claim 7, in which the filter unit (FT) has side walls, which are made, at least portion-wise, entirely, of an optical at least partially transparent material.

9. The water pump according to claim 1, in which a liquid sensor is alternatively or additionally provided, which sensor detects the liquid level in the region of the pump unit and signals the same at the transparent window (FE).

10. The water pump according to claim 1, in which a pressure sensor, which is connected to a control unit, is arranged on the pressure line (DL).

11. The water pump according to claim 1, in which a return valve (RV) is provided, which is part of the filter unit operating as a filling opening.

12. The water pump according to claim 1, in which the passage channel (DK) is arranged on a valve plate (VT) of the return valve (RV) and the sealing ring (DR) is arranged in a slidable manner with an overlying adjusting disk on the side of the pressure line (DL) along a valve stem (VS) of the return valve (RV) under the action of a spring bias.

13. The water pump according to claim 1, in which the return valve (RV) actuates a switch (ST), which in case of a dry run, transmits a signal to a control device.

14. The water pump according to claim 13, in which the switch (ST) is a magnet switch, in particular a REED-switch or a Hall sensor, which is actuatable by means of a magnet, which is arranged on the return valve.

15. The water pump according to claim 13, wherein the switch (ST) additionally or alternatively activates a scald-protection when the water pump is operated against a closed pressure line.

* * * * *